United States Patent [19]

White

[11] 4,205,766

[45] Jun. 3, 1980

[54] DUAL COMPARTMENT DISPENSING CONTAINER

[76] Inventor: Douglas J. White, 173 Hillside Ave., Nutley, N.J. 07110

[21] Appl. No.: 667,331

[22] Filed: Mar. 16, 1976

[51] Int. Cl.[2] ..... B67D 5/56

[52] U.S. Cl. ..... 222/135; 222/153; 222/320

[58] Field of Search ..... 222/135, 153, 162, 320, 222/328, 386, 553, 570, 543

[56] References Cited

U.S. PATENT DOCUMENTS

| | | | |
|---|---|---|---|
| 593,333 | 11/1897 | Park | 222/386 UX |
| 2,001,819 | 5/1935 | Elle et al. | 222/162 X |
| 3,208,645 | 9/1965 | Rayner | 222/320 X |
| 3,715,063 | 2/1973 | Susuki et al. | 222/570 X |

FOREIGN PATENT DOCUMENTS

| | | | |
|---|---|---|---|
| 509508 | 3/1952 | Belgium | 222/543 |
| 2302275 | 1/1973 | Fed. Rep. of Germany | 222/386 |
| 71080 | 10/1952 | Netherlands | 222/320 |

*Primary Examiner*—Robert J. Spar
*Assistant Examiner*—Frederick R. Handren
*Attorney, Agent, or Firm*—Lowe, King, Price & Becker

[57] ABSTRACT

A container for fluid products having telescoping parts and operable by outside manual pressure is provided. A base cup open at the top receives a plunger cup that is slidable therein with product being filled in both cups. A slidable piston in the plunger cup dispenses product from the plunger cup concurrently with the dispensing of the same or different product by the plunger from the base cup. A dispensing nozzle is provided in one of the cups with a transfer tube connecting the nozzle to the other cup. The container assembly includes four injection molded plastic parts, namely, (1) the base cup, (2) the plunger cup, (3) the piston and (4) the cap and nozzle assembly; these parts snapping together during the combined filling and assembling process. Integral snap rings and snap beads are used to lock the parts together. Once assembled, the piston locks the plunger cup against either in or out telescoping movement to prevent accidental dispensing during shipping and handling. Additional break-off safety strip and heat shrink band at the juncture between the cups may be employed. In products requiring longer shelf life, the band may be required, as well as flip-up or rotary cutoff valves as disclosed. Check valves may be advantageously employed, especially for products of low viscosity. Different viscosity products are accommodated by sized passages and orifices, reducing inserts for the passages and/or multiple passages. The process provides filling the base cup, assembling the plunger cup and piston and combining with the base cup, filling the plunger cup and installing the cap and safety strip and seal band.

16 Claims, 15 Drawing Figures

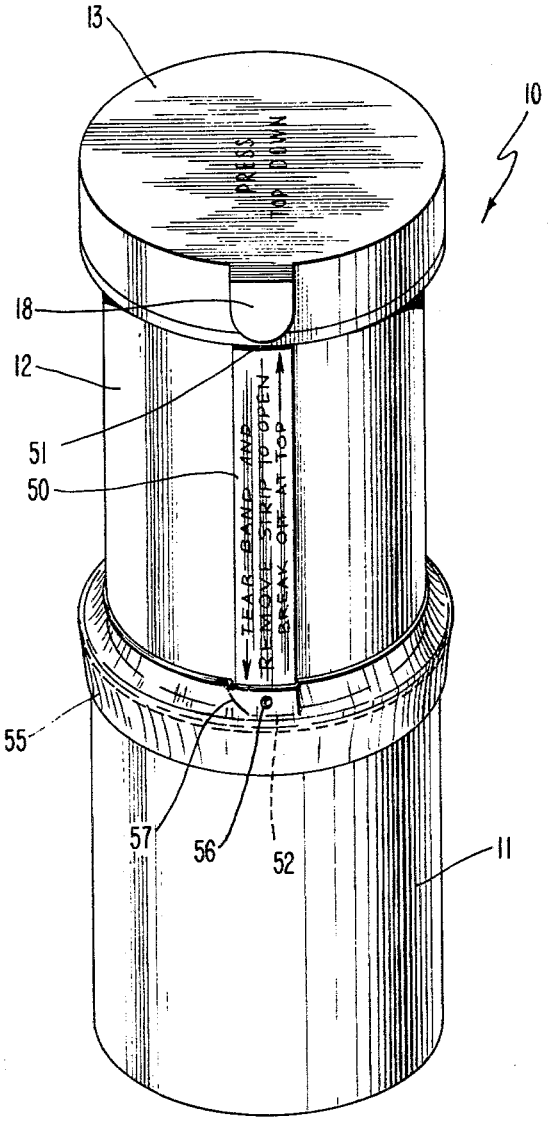
Fig. 1
Fig. 2
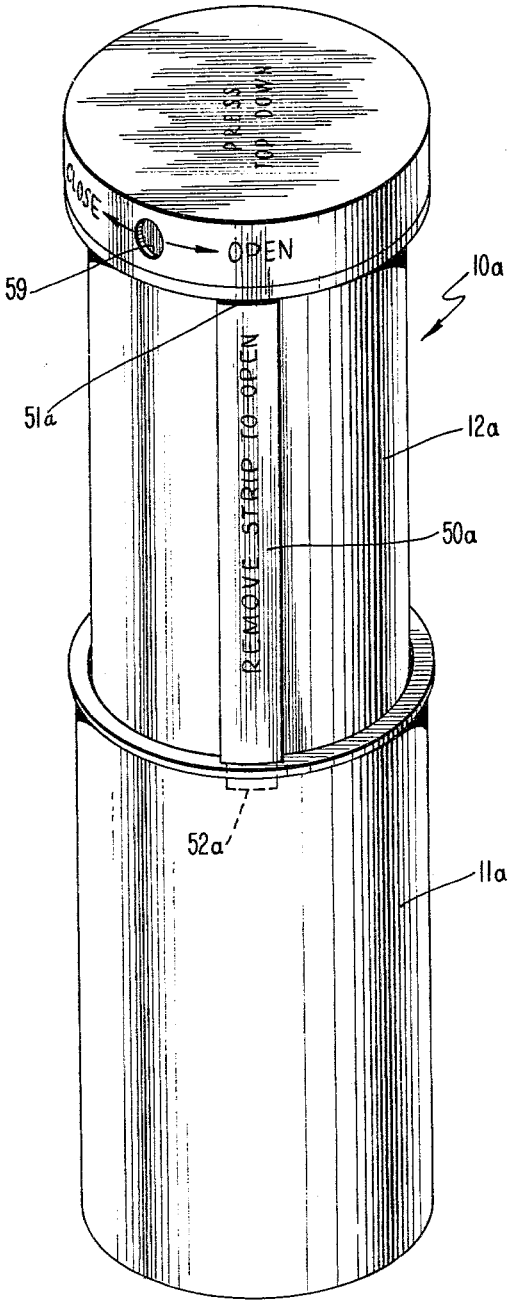

Fig. 13
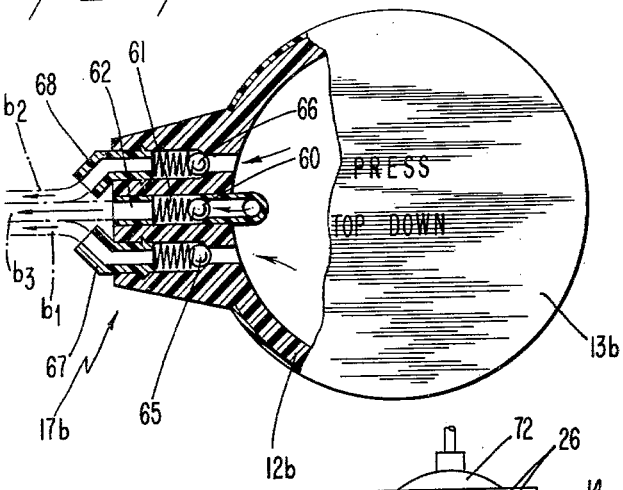
Fig. 14
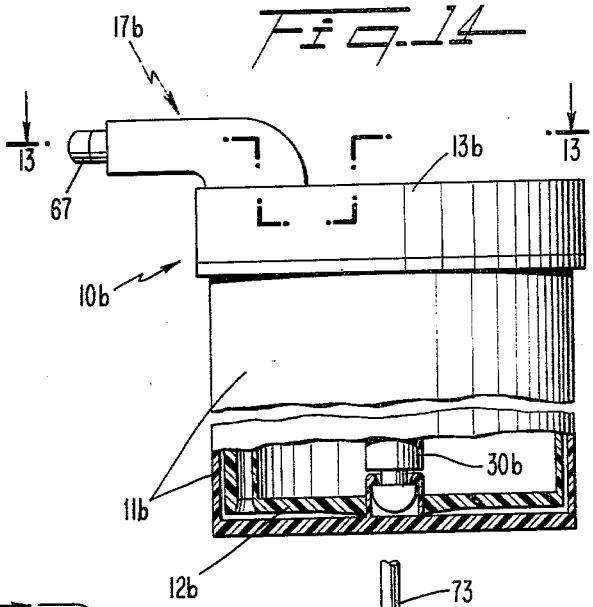
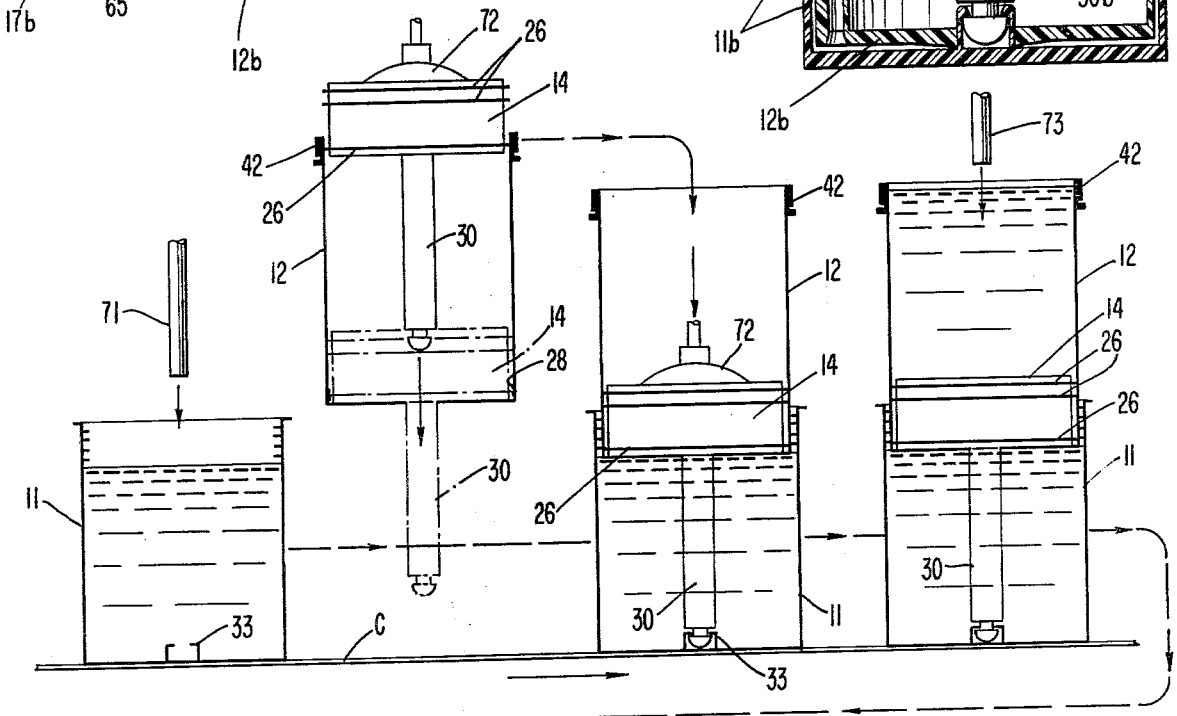
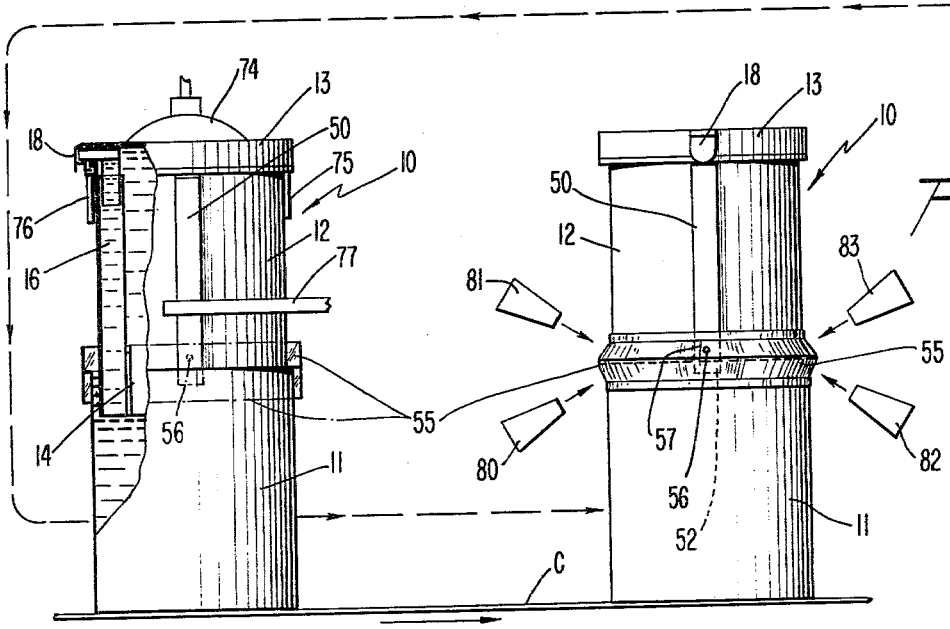
Fig. 15

DUAL COMPARTMENT DISPENSING CONTAINER

FIELD OF THE INVENTION

The present invention relates to dispensing containers, and more particularly to an improved container having telescoping cups for dispensing the same or codispensing different products.

BACKGROUND OF THE INVENTION

In marketing in today's world, there is a need for new consumer products to be attractively packaged in a new and better containers. This is especially true in the cosmetic and related industries, where a company seeking to compete for a share of even a very narrow market usually finds it is facing at least two or three well established similar products. Although the exact degree will vary, recognized marketing experts do not vary in opinion that an improved package is most important to new product success under these circumstances.

For a company having many and varied consumer fluid products in the above-identified field, it is felt that some of the most important criteria for an improved container that would provide new product success, as well as a sale impetus to selected ones of established products are: (1) a self-dispensing container allowing precise control; (2) a container attractive and novel, but inexpensive to manufacture; (3) a container adaptable to a wide range of products from thin to highly viscous liquids to even granular powders; (4) a container requiring no internal propellants that may pollute the atmosphere; (5) a container easily operated by mild manual pressure requiring use of only one hand, and (6) a container easily filled, assembled and sanitary sealed on a production line with relatively few modifications required on existing machines.

In the past, of course attempts have been made by companies, and individuals alike, to provide such a dispenser. But, insofar as we are aware, the attempts have fallen short on these desirable features.

The collapsible tube dispenser and the plastic squeeze bottle are two examples of old and well known containers that meet some of the prerequisites, but not nearly all. Other containers, such as shown in the Elle et al U.S. Pat. No. 2,001,819, have made attempts at reaching the objectives, but when put to the test, failed miserably. Specifically, this previous container falls short on at least listed items (1), (2), (3), (5) and (6). Its basic structure has been judged incapable of being successful by the marketplace, the most thorough and accurate judge and tester of all.

Contrary to the earlier attempts made at improving fluid dispensing containers of this type, I set out with the premise that it might be important to provide certain basic conceptual mechanical changes. Between the old collapsible tube, and the tested but unsuccessful telescoping container, I decided that the latter had the best, indeed what I thought was exceptional potential, mainly because it would at least be new and different to the consumer. But, in its stripped form, I have found from firsthand experience it did not measure up to five of the six more important criteria that the market was asking for, as outlined above.

I then discovered the basic conceptual structural changes required for success, along with other important features and improvements, as disclosed and claimed in this patent.

Direct communication between both of the reservoirs to a new dispensing nozzle is important. This combination feature provides more precise control of the dispensing function of fluids over the complete spectrum of viscosities and allows use of the container for dispensing two different products, even with widely varying viscosities, without modification.

Only four parts easily snapped together are required, and once assembled make the container tamper-proof. Also, our container is easily filled during assembly because of this feature.

An interlocking system of parts allows the container to experience normal handling and shipping prior to use, without the fear of spillage or premature dispensing of the product. This feature contributes as well to accurate positioning of the parts during assembly to assure full filling.

A sealing system gives the container competitive shelf life for the products packaged, and, coupled with the interlock system helps meet the standard consumer safety code requirements.

A stand-up or hold-in-the-hand structure is easy to operate for the consumer using only mild pressure and only one hand.

OBJECTIVES OF THE INVENTION

Thus, it is one object of the present invention to provide a dispensing container avoiding the shortcomings of the prior art and having the attributes discussed above.

It is a more specific objective of the present invention to provide a dispenser of the type described that is inexpensive to manufacture and can be assembled and filled in one easy operation on existing type machines.

It is another objective of the present invention to provide a telescoping dispenser operable by outside manual pressure and wherein the parts permanently snap together to prevent spillage or tampering, and for this reason are safe to have around children.

It is another object of the present invention to provide a dispensing container assembly that requires no change for conversion to codispensing and wherein products across the full spectrum of viscosities can be handled separately or together.

It is still another object of the present invention to provide a telescoping container making maximum utilization of the space for holding products and allowing dispensing of the product without the need for more than one hand of the user.

Still other objects and advantages of the present invention will become readily apparent to those skilled in this art from the following detailed description, wherein I have shown and described only the preferred embodiments of the invention, simply by way of illustration of the best modes contemplated by me of carrying out our invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE INVENTION

The container assembly has a base cup, and a plunger cup telescopingly positioned in the open top thereof. The base cup is adapted to rest on a table or other convenient surface while product is dispensed by applying a force requiring only mild pressure to the top of the plunger cup. The product is dispensed through a nozzle at the top of the plunger cup into the hand of the user.

The container is designed so that by applying the pressure with the thumb, the product may be dispensed across the fingers of the user. This makes the container have a high degree of utility, especially if the product is to be applied to the body; namely for example, medicinal body creams, hand lotions, shampoos and hair conditioners. In the case of using baby products, this is very important since the mother can keep one hand on the child while dispensing the product with the other without even picking up the container.

Alternatively, utilizing both hands, pressure may be applied to the top with the fingers of one while the product flows onto the fingers of the other hand. The container can be either resting on a suitable surface, or in the case of smaller containers manufactured in accordance with the present invention, the container can be both held in one hand and the pressure applied with either the thumb or index finger of the same hand. Of course, the outlet orifice of the nozzle can also be directed to apply the product directly to any other object, as desired.

The two cups are provided with sealing means at the sliding interface and this can take the form of integral peripheral wiping beads formed adjacent the top of the inside wall surface of the base cup. A transfer tube extends from the base cup to the nozzle to provide direct communication between the product chamber in the base cup and the outlet orifice. The nozzle has a direct feed passage to pass the product from the product chamber in the plunger cup.

The feed pressure in the plunger cup chamber is provided through a piston inside this cup that is fixed in relationship to the base cup so that it slides relatively along the inside wall as the plunger cup is telescoped into the base cup. Similar integral bead sealers or wipers may be provided on the piston to assure full product dispensing and to prevent undesirable bleed-back.

Since the product in the base cup and the product in the plunger cup communicate with the nozzle through different pathways, the products may be either the same or different, but in either case the dispensing is provided in a very precise, controlled manner. Since the product fully fills the internal chambers, there is an effective vacuum condition tending to hold the product in the container. The telescoping movement is smooth and non-resilient or inflexible. This eliminates any tendency for the product to "suck back" into the container, as is characteristic of tubes and squeeze bottles.

With moderately viscous products, no additional valving is needed to assure against accidental spillage. The natural flow resistance, vacuum in the container and surface tension of the tip of product in the outlet orifice holds the product safely in the container. Snap-close shut-off valves are desirable with most products to prevent drying. One-way check valves may be provided where products of minimum viscosity are being dispensed. With check valves, even if the container is turned upside-down, leakage does not occur since the static head pressure, and this is limited by the vacuum in the container, does not unseat the valve.

Further in accordance with the dispenser of my invention, the piston is operative to lock the plunger cup and the base cup permanently together so that accidental spillage or complete separation of the cups cannot occur. A snap ring engages the bottom of the piston rod and snap bead combinations properly position the piston in the bottom of the plunger cup. To provide initial use, moderately increased pressure is momentarily applied to the top to force the sealing bead past the cooperating snap bead on the inside wall of the plunger cup.

The cap for the plunger cup is also provided with an integral snap-on ring, that once placed on the container cannot be easily taken off; and thus, this makes the entire container tamper-proof.

The cap also advantageously has formed as an integral part thereof, the nozzle that includes feed passages from both cups. A reduced portion nipple is provided on the nozzle for engaging the transfer tube in the plunger cup, thereby providing the flow connection and also additionally locking the cap in position.

In a second or alternative embodiment, the nozzle may be formed integrally with the plunger and the integral transfer tube extending along one side of the plunger cup. In this embodiment, the cap also includes a peripheral snap ring and the cap can be rotated on the top of the cup to align a valve port.

The base cup may include an upstanding hollow rod into which a reduced diameter portion on the bottom of the piston fits and is locked by a suitable bead snap lock. A stop is provided to prevent the piston from moving downwardly to the bottom of the plunger cup thereby preventing separation of the cups. In both this embodiment and the preferred embodiment, the piston should include a partial circular, cut-out section to accommodate the transfer tube extending along the inside wall.

The nozzle may include a modified embodiment wherein feed passages extend upwardly and outwardly from the top. This allows a reduction in size of the upper shoulder of the plunger cup and maximum filling of the container with product. The check valves may be more easily accommodated in this modification. Also dispensing of products to be combined outside the container, may be realized by separation of the feed passages.

Also, as can be seen in this modified embodiment, more than one passage can be provided for either or both of the products. Multiple passages may allow easier dispensing of particular products in addition to providing a better mix of the product beads that may be desirable.

Furthermore, the feed passages in the nozzle may be gauged as to size in order to meet the specific requirements of any particular product. Permanent inserts may be used to reduce these passages and thereby allow products of a lesser viscosity to be dispensed from the same container in a controlled manner.

The products are dispensed in equal proportions regardless of their viscosity. A less viscous fluid product should normally be dispensed through a smaller orifice in order to maintain control.

In the process of filling and assembling the container in accordance with the present invention, the base cup is normally placed on a suitable conveyor, which for example may be an in-line arrangement. The base cup is filled to the height that fills completely the product holding chamber and the transfer tube after the plunger has been installed.

Separately, the piston is inserted into the plunger cup and the wiping bead is snapped into position in the bottom of the cup. At the next station, the plunger cup and the piston assembly are locked into the base cup. During insertion, the air trapped in the base cup escapes up the transfer tube and product from the base cup fills the transfer tube just before the piston rod on the piston locks in the snap ring at the bottom. A suction cup handler or other mandrel may be used to assure that the parts are stable as they come together.

The plunger cup is now filled with product, again to the desired pedetermined level. If the product is highly viscous or if a suitable valve is used, the product is filled to the upper lip of the plunger cup. At the next station, the cap is snapped into position while the shoulder around the top of the plunger cup is held steady by guide rails.

The cap may include a depending safety strip that insures integrity of the product to the customer. A heat shrink ring seals the interface between the two cups. Hot air blown at the final station positions and activates the ring to the sealing position. The ring also assists in locking the parts together prior to use.

BRIEF DESCRIPTION OF THE DRAWINGS

FIG. 1 is a perspective view of the preferred embodiment of the container assembly of the present invention, the container being ready for removal of the safety strip and band for use;

FIG. 2 is an alternative embodiment, also shown in a perspective view;

FIG. 13 is a top view of the top for the plunger cup of a modified container and including a cutaway section of an alternative form of a nozzle with dual passages from one chamber and check valves;

FIG. 14 is a side view of the modified container and nozzle of FIG. 13; and FIG. 15 is a composite step-by-step illustration of the filling and assembling process.

DETAILED DESCRIPTION OF THE PREFERRED EMBODIMENT

Figure 3:
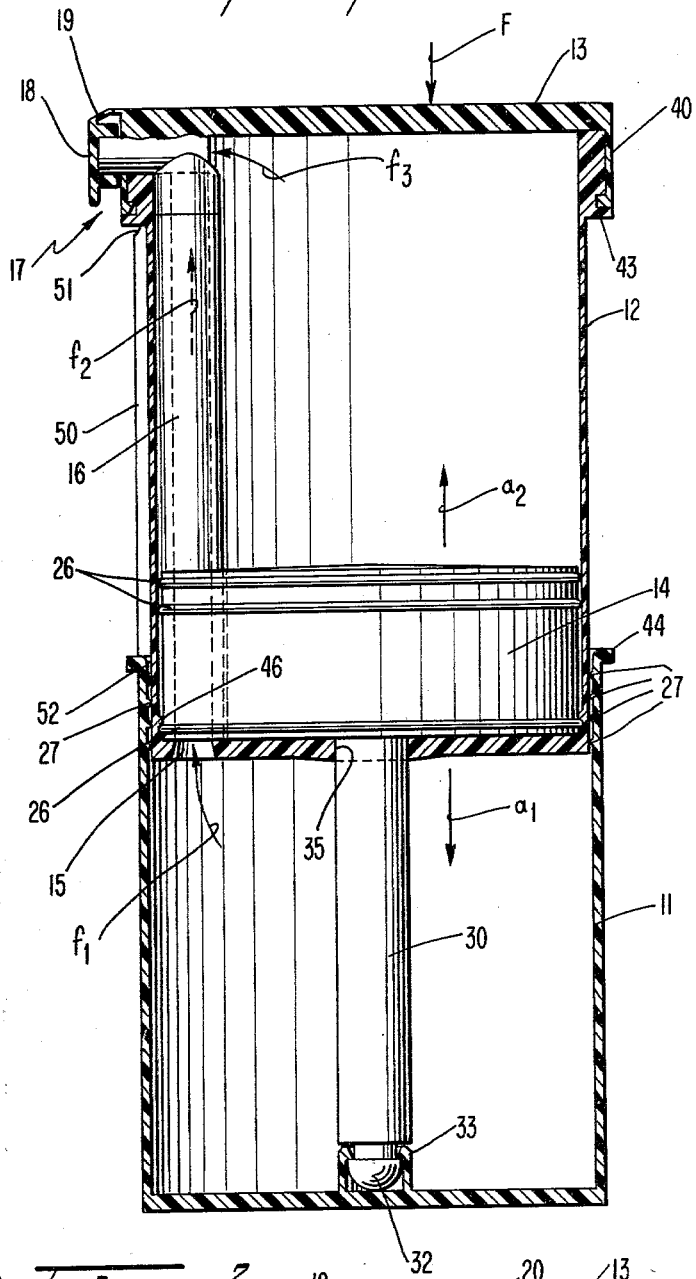
FIG. 3 is an exploded view of the container assembly in accordance with the preferred embodiment of FIG. 1 and showing the manner in which the four parts are to be assembled.

Referring now with more specificity to FIG. 1 of the drawings, there is shown a container assembly 10 constructed in accordance with the principles of the present invention. The assembly 10 includes a base cup 11, a plunger cup 12 and a top 13 for the plunger cup. These three parts can be also seen and the assembly more fully understood by viewing FIGS. 3 and 4. The fourth part of the assembly, piston 14 that fits within the plunger cup 12 may also be seen in FIGS. 3 and 4.

Figure 4:
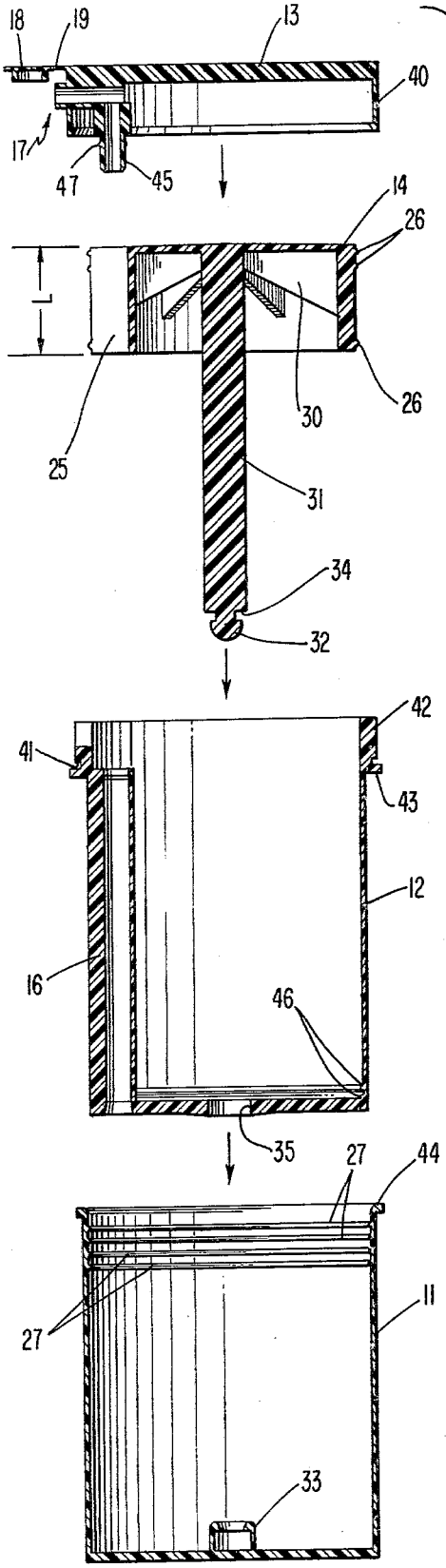
FIG. 4 is a cross-sectional view taken through the middle of the preferred embodiment container of FIG. 1.

Briefly in operation, when an outside force is applied by manual pressure, as represented by the arrow F, to the top 13, the plunger 12 starts to move down as noted by the movement arrow $a_1$ (see FIG. 4). Piston 14 remains stationary with respect to the base cup 11, so that in terms of relative movement the piston 14 moves up the plunger 12. This relative movement has been depicted in FIG. 4 by movement arrow $a_2$.

As a consequence of this compound movement, the product in the chamber of the base cup 11 is forced up through an opening 15 in the bottom of the plunger cup 12 and into transfer tube 16 formed integrally along the inside wall of the cup. At the top of the plunger cup 12, the product will enter the nozzle, generally designated by the reference numeral 17 (note the flow arrows $f_1$ at opening 15 and $f_2$ adjacent the top of the transfer tube 16).

Figure 5:
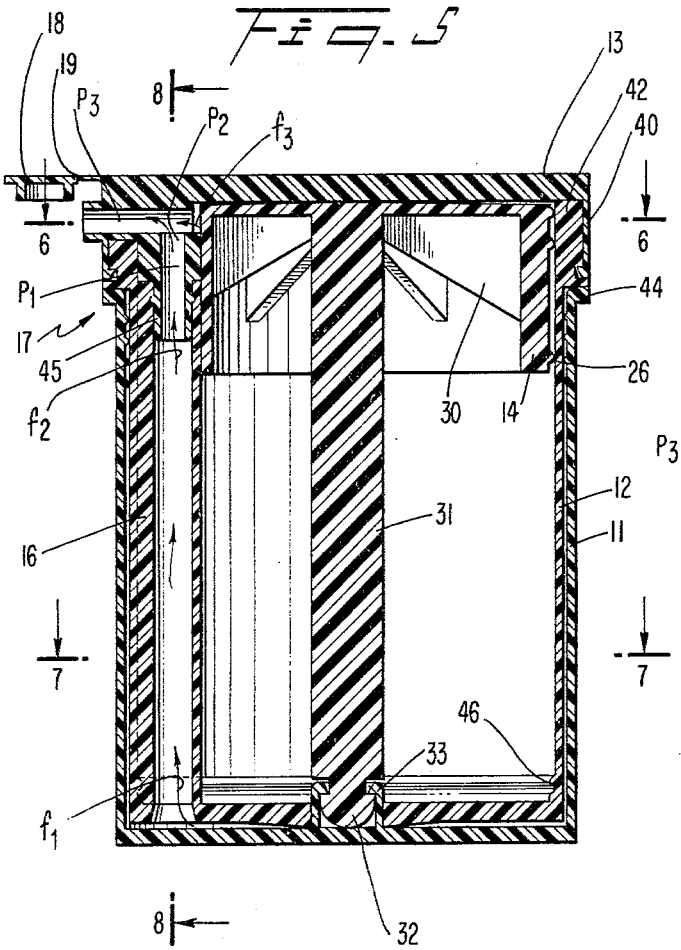
FIG. 5 is a cross-sectional view taken through the middle of the container but with the assembly completely telescoped and the product fully dispensed.
Figure 6:
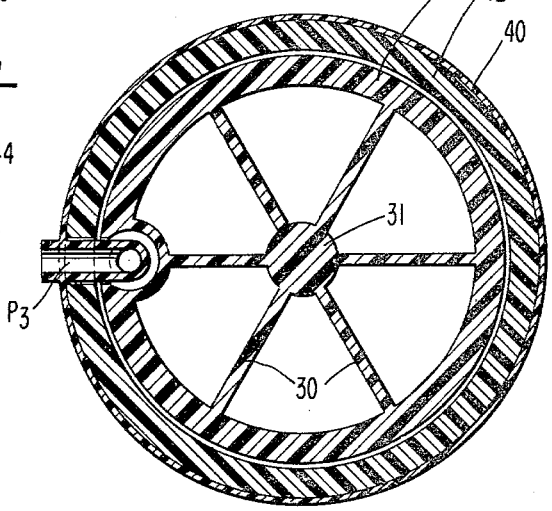
FIG. 6 is a cross-sectional view along line 6—6 of FIG. 5.
Figure 7:
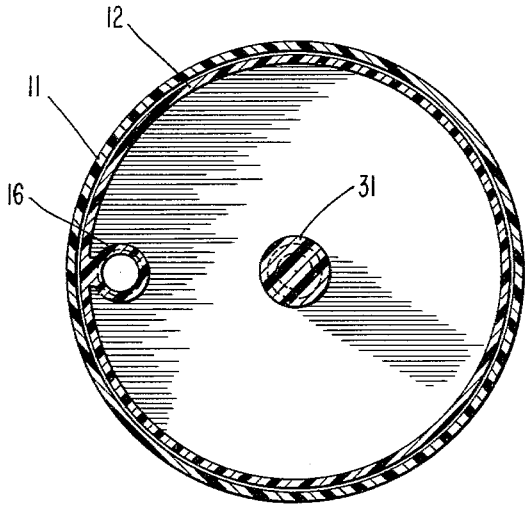
FIG. 7 is a cross-sectional view along line 7—7 of FIG. 5.
Figure 8:
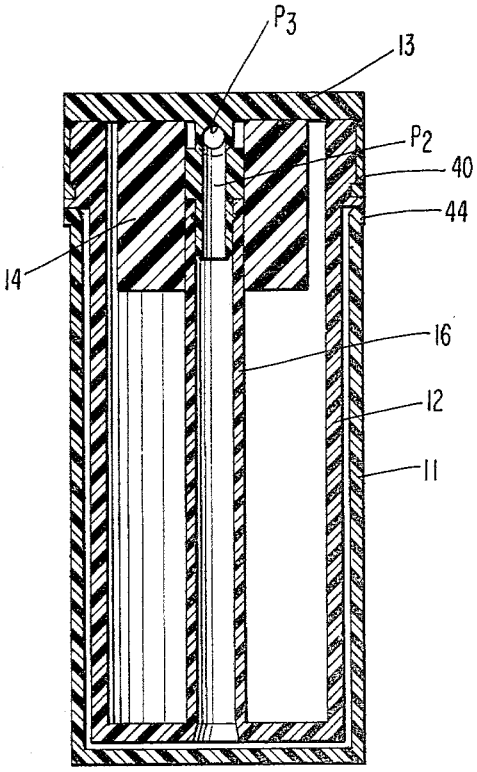
FIG. 8 is a cross-sectional view taken through the nozzle only of the container at line 8—8 of FIG. 5.

Simultaneously, the relative movement illustrated by the arrow $a_2$ causes the product in the chamber formed by the plunger or upper cup 12 to tend to flow in the direction of flow arrow $f_3$, as also shown in FIG. 4. When the product is fully expelled, the inward telescoped position of FIG. 5 is reached.

All of the parts are made of a suitable plastic, such as a high density polyethylene, polypropylene or any other plastic that exhibits the requisite strength characteristics and is inert to the product being packaged. Known injection molding techniques have been found to be suitable for forming the parts. However, it should be understood that other suitable materials, such as metals or the like that may be required by other products and other manufacturing techniques, such as casting and/or machining, can be utilized in accordance with the basic principles of the present invention.

With plastic, the container assembly 10 of my invention is not only low cost, but it can also be made so as to easily snap together during filling and assembly. The locking devices are one-way so that after the parts are snapped together, they cannot be easily taken apart to provide the package with the tamper-proof feature.

The package is aesthetically attractive and can be provided with any decorative printing, such as by silk screening, directly on the outer wall surface (such decorative printing not shown). In addition to cylindrical, other desired shapes, such as rectangular or oval, may be employed to provide additional attractiveness and distinctiveness to the container to enhance customer identification of the product being packaged.

SINGLE AND DUAL PRODUCT DISPENSING FEATURES

As mentioned above, one of the important features of my container assembly 10 is that no modification is required in order to convert from dispensing of a single fluid product, such as hand lotion or medicinal cream, to a codispensing mode where two separate products are dispensed simultaneously and mixed in the nozzle 17 ready for use, such as shampoo and cream rinse. The reason for this is that the product in the upper chamber, that is the chamber formed by the plunger cup 12, flows through a path $f_3$ that is separated from the path $f_1$, $f_2$ of the product from the lower chamber, or the chamber formed by the base cup 11. Thus, the upper and lower chambers both communicate directly with the nozzle 17. More specifically, the product flowing along path $f_3$ enters a first feed passage $p_1$; whereas, the product flowing along path $f_1$, $f_2$ enters the nozzle 17 along a second feed passage $p_2$. At the intersection of the feed passages $p_1$, $p_2$ the products are mixed and then dispensed through the outlet passage $p_3$.

A stopper 18 may be provided to place over the outlet orifice to seal the container when not in use. This stopper is attached to the cap 13 by a living hinge 19 that is simply a reduced section of plastic material to allow easy flexure to the open position (see FIGS. 3 and 5). With the natural memory in the hinge 19, the stopper tends to stay in the open position of FIG. 3 (see also FIG. 5). A tab at the outer edge of the stopper facilitates gripping by the finger to flip the top to the open position.

When either dispensing the same product, or codispensing different products, because of the mechanical interrelation of the parts, the user is assured of receiving from the nozzle 17 equal proportions of product from the two chambers. If one of the products is more viscous than the other, it is desirable to make the two feed passages $p_1$, $p_2$ of different bore diameters. For example, if a relatively viscous product is used in the upper chamber, such as shampoo, and a less viscous product is used in the lower chamber, such as hair conditioner, it is desirable to provide more flow resistance along the passage $p_2$ than along the feed passage $p_1$ to assure constant and accurate control of the product when the dispensing force is applied.

One method of assuring the proper control is to merely provide mold parts for the injection molds that have the desired diameter to form the bores. However, another way of doing this is to provide insert tubes in one or the other of the feed passages $p_1$, $p_2$. Thus, inserts 20, 21 in the passages $p_1$, $p_2$, respectively, may be used, either singly or together. The inserts are secured in position by using plastic weld solvent during the assembly process.

Figure 12:
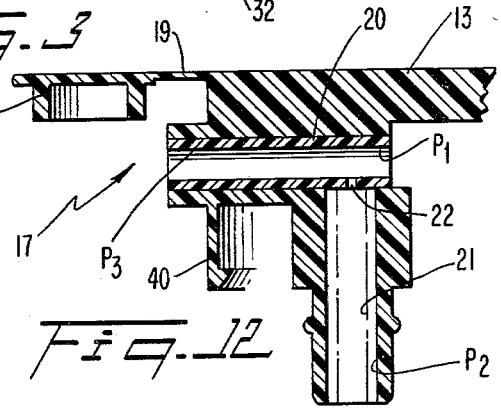
FIG. 12 (sheet 2) is a partial cross-section through the nozzle of the container of the preferred embodiment, showing the use of an insert.

The lesser the viscosity of the product, the more restricted the feed passages $p_1$, $p_2$ should be made so as to provide the proper pressure threshold for dispensing of the product. Advantageously, a control orifice, such as lateral control orifice 22 in the insert 20 may be utilized to eliminate the need for insert 21 (shown dotted line in FIG. 12). The insert 20 is mounted permanently by simply applying solvent to the interface as the parts are assembled.

With precise control of product, not only can the proper threshold pressure be regulated so that the same pressure is required regardless of the material being dispensed, but also the resistance of flow between the two products can be made to contribute substantially equally to the pressure being applied for dispensing.

The proportions of the products in the case of codispensing may be regulated by simply providing an inert carrier in one of the other of the fluids. If the carrier changes the viscosity of the product, then the bore size of the passages $p_1$, $p_2$ are adjusted accordingly. Once the optimum sizes of the passages are determined, both empirically and by trial and error methods, all containers for that combination of product or products is set and no changes are necessary.

Under severe variations in climate conditions, products may require different size passages. By utilizing the insert concept, these changes can be readily made from standard container injection molded parts.

A mild pressure, of approximately five pounds per square inch, has been found to be optimum. This is comfortable for most persons and in this range the force may easily be controlled to give precise dispensing. For all products dispensed, selecting the feed passage and orifice sizes to hit this optimum pressure is desirable.

The piston 14 includes a recess or cut-out portion 25 (see FIG. 3) to accommodate the transfer tube 16 and the nozzle 17 at the top of the stroke (note also FIG. 5). The piston is desirably made with an extended length L in the axial direction (see FIG. 3) and includes integral sealing beads 26 at the top and bottom of the piston. These sealing beads provide good wiping action along the length of the plunger cup inside wall. This extended length piston serves as an important means for stabilizing the plunger cup 12, especially in the initial position. It can be seen by noting FIG. 4, that the piston forms a solid area support spanning the area of engagement of the plunger cup 12 with the base cup 11. This means that lateral forces applied at the top of the plunger cup 12 are more effectively resisted. This added support also allows the plunger cup 12 to start at a location higher in the base cup 11 than would otherwise be allowable. The interface between the cups is provided with sealing beads 27 on the internal wall of the base cup 11.

With the proper tolerances, bleed-back around the sealing beads 26, 27 is minimal. When product does escape through one of the beads adjacent the product chamber, the product will be trapped behind the next bead. The amount of product escape past any single bead is negligible and thus there can be no product expected to work its way through to the opening at the interface between the parts under normal operating conditions. Of course, with less viscous products, the greater number of sealing beads and the closer tolerances are desired. On the other hand, with more viscous products, a single bead, or even no beads at all is desirable. The product around the area of the sealing beads 26, 27 serves to lubricate and thus control the pressure action described above. By providing for less lubrication and more friction, the resistance to movement of the parts can be increased, and vice versa.

CONTAINER ASSEMBLY INTERLOCKS

An important concept of our invention is the structure allowing locking of the four parts together during the assembling process. These locks are designed to prevent accidental dispensing or spilling under circumstances that could normally be expected. Just as importantly, the locking of the parts provides a package that is safe to have around children and infants, since once assembled the parts cannot be easily disassembled.

The piston 14, in addition to providing the stabilizing forces at the interface between the base cup 11 and the plunger cup 12, forms an important part of this mechanical interlock system. The piston 14 with radial reinforcing ribs 30 supports a piston rod 31 having at its distal end formed as a reduced portion 32. The reduced portion or button 32 has a curved or hemispherical end face to serve as a guiding surface for engaging a snap ring 33 integrally formed on the inside bottom of the base cup 11 (see FIG. 4). Just above the reduced portion 32 is an undercut groove 34 (see FIG. 3) in which a peripheral one-way hook or prong element at the top of the snap ring 33 is designed to fit. During installation, the curved face of the portion 32 engages the tapered upper face of the hooks, flexes open the plastic snap ring, and then snaps into the locked position. Once snapped together, the piston 14 cannot be withdrawn because the prongs are seated in the undercut groove 34.

As the plunger 12 moves downwardly during the dispensing operation, aperture 35 in the bottom of the cup moves along the stationary piston rod 30 and makes a smooth transition over the snap ring 33 (see FIG. 5). A slight crown is provided around the aperture 35 to insure that the maximum amount of product is expressed out of the product chamber and up the transfer tube, as clearly shown in FIG. 5. Similarly, the interconnection between the nozzle 17 and the plunger cup 12 is continuous so that the relative movement of the piston 14 in accordance with arrow $a_2$ expresses full product out the passage $p_1$. A slight crown may also be provided on the top of piston 14 to assure full flow of the product.

The cap 13 is provided with an integral snap ring 40 around substantially its full peripheral extent. The ring 40 has a hook portion that is accommodated in groove 41 (see FIG. 3) formed in the enlarged top shoulder 42 of the upper cup 12. Just below the groove 41 is a lower shoulder 43 that mates with rim 44 of the base cup 11 when the container has been fully telescoped (see FIG. 5). Notice should be made that the snap ring 40 also cannot be removed once it is placed in position during assembly. The shoulder 43 extends out flush with the outer face of the ring 40 so that a tool cannot be inserted to forcibly release the hook portion.

The nozzle 17 has been formed integrally with the cap 13 so that the second passage $p_2$ must be connected to the transfer tube 16 during assembly. This is accomplished by providing a reduced nipple 45 having a locking bead 47 adapted to fit in a mating recess within the inside wall of the transfer tube 16 (see FIG. 5). This snap-together joint assures a good seal for the fluid passing from the lower chamber to the nozzle 17 and also provides an additional point of interlock to hold the cap against removal once the container has been filled and assembled.

The lowermost bead 26 on the piston 14 serves to properly locate the lower edge against the bottom of the plunger cup 12 and provide a detent mechanism that must be overcome to initiate the dispensing operation. The lower bead 26 is for this purpose positioned between cooperating snap or detent beads 26. In practice as the dispenser is brought to the operating mode, this snap action requires a travel of only a fraction of an inch but gives the user a definite signal to indicate that dispensing is commencing. Likewise, during assembly, a definite signal is given as the bead 26 passes over the cooperating snap bead 46, thus making assembly of these two parts more controlled.

As a final safety interlock and product integrity control device on my container assembly 10, I provide a safety strip 50 that extends from below the shoulder 43 down to engagement with the upper surface of the rim 44 on the base cup 11. The strip 50 is sufficiently stiff to resist flexure by pressure applied to the top 13 of the container. This provides an outwardly, visible indicator to the purchaser that the container has not been tampered with since it left the manufacturer. The upper end of the safety strip 50 is notched at 51 in order to provide a convenient break point. The lower end of the strip 50 has a reduced lip 52 that is tucked in behind the rim 44 of the base cup. The strip 50 is molded as an integral part of the cap 13, and as will be discussed below, is assembled to the container with the cap.

A heat shrink band 55 is provided around the girth of the container assembly at the interface between the base cup and the plunger cup 11, 12. This band is carried during assembly preferably by a spot weld point 56 on the end of the band 50. Upon application of heat during the assembly process, the heat shrink plastic band contracts, snugly engaging both cups across rim 44, and thus further locking the cups together. A seal is now formed to provide full sanitary protection of the contents until the moment the container is opened for use. The shelf life of the product within the container is enhanced by having this positive seal at the interface between the parts.

To open, the customer simply grips the safety strip along its lateral edges flexing the strip outwardly to release the tucked in lip 52. As the lip 52 is released, the weakened point at the notch 51 is broken and the strip can then be used to help tear the band 55 beginning at the starting slit 57 which overlies the distal end of the strip 50 (see FIG. 1). The strip 50 and band are removed as an assembly and discarded.

VALVE IN PLUNGER CUP AND MODIFIED PISTON

In the alternative form of the device of the present invention, shown in FIGS. 2 and 9–11, identical parts have been denoted by the same reference numerals as used in the container of the first embodiment with the addition of suffix a. This design has been found to be adaptable for smaller containers, such as purse-size lotion or the like.

Figure 9:
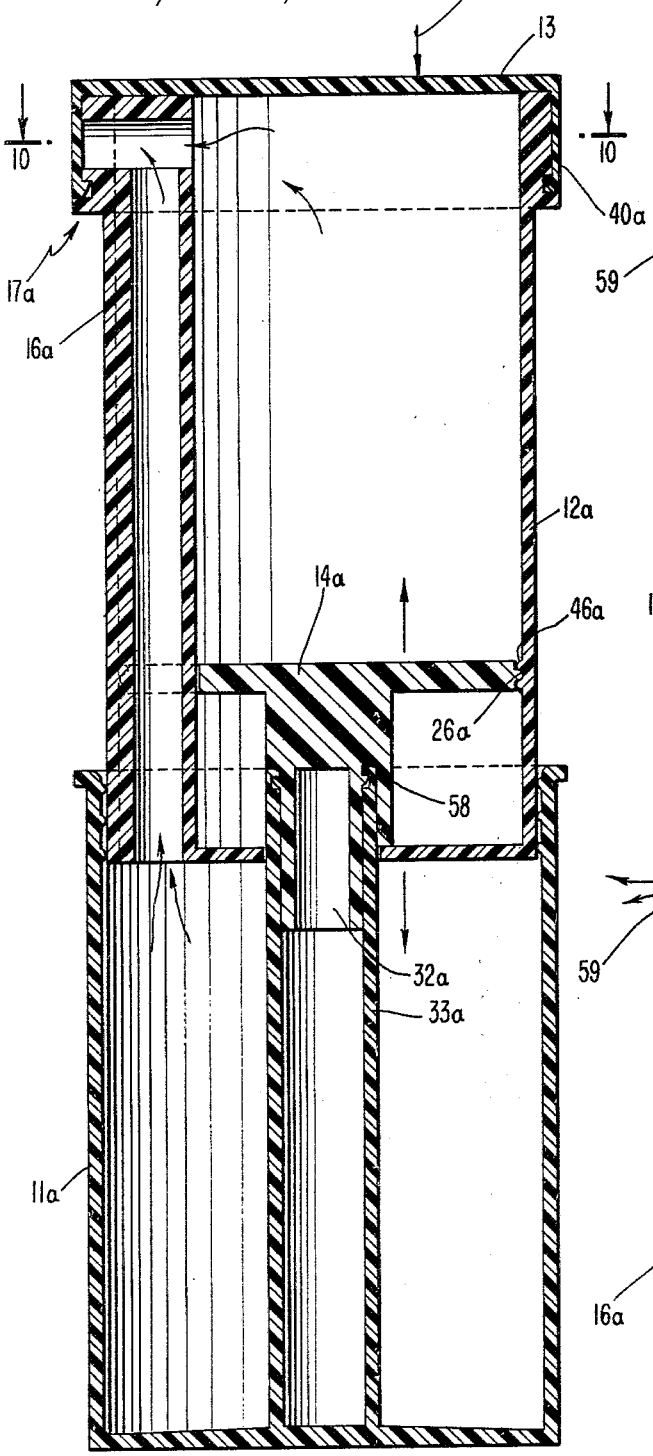
FIG. 9 is a cross-sectional view taken through the container of the alternative embodiment shown in FIG. 2 and with the parts shown ready for opening of the cutoff valve and dispensing.
Figure 10:
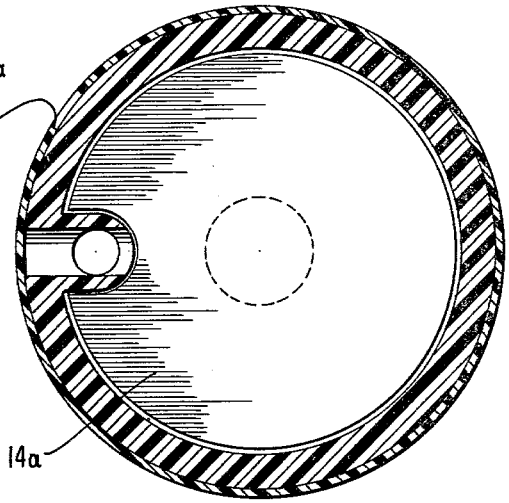
FIG. 10 is a cross-sectional view taken along line 10—10 through the top of the container.

First, the piston takes a different form, as is denoted by reference numeral **14*a* in FIG. 9. The piston has a relatively thin working body with a single wiping bead 26*a*. The detent beads 46*a* serve to locate and hold the piston in proper position. A positive act of applying sufficient force $F_a$ to cause the piston 14*a*** to snap out of position is required to initiate dispensing.

A stop 58 along the center of the piston **14*a* serves as a positive limit to upward movement of the plunger cup 12*a*. A reduced portion 32*a* fits within elongated ring 33*a* integrally formed to the bottom of the base cup 11*a* thereby performing the same interlock function as the alternative construction of FIG. 4. A locking bead is seated within a mating recess in the ring 33*a*** to provide the actual locking engagement.

Figure 11:
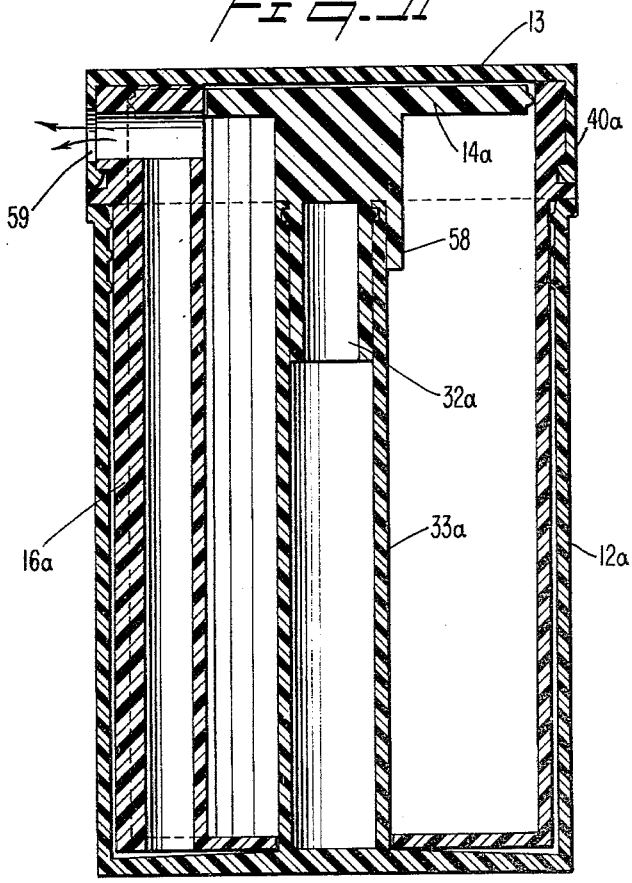
FIG. 11 is a cross-sectional view like FIG. 9 but with the parts telescoped to show the condition when the product has been dispensed.

The nozzle **17*a* of this alternate embodiment is formed integrally with the plunger cup 12 and is an extension of the transfer tube 16*a*. The same flow pattern as before is provided, as indicated by the flow arrows in this Figure. The snap-on cap 13 has the full peripheral snap ring 40*a* and this ring is provided with a valve port 59 (note FIGS. 2, 10 and 11). The cap 13 is rotatable in order to bring the port 59 into alignment with the output passage, as illustrated in FIG. 11. This provides an extremely efficient cut-off and presents a very aesthetically pleasing container, as will be recognized. A safety strip 50*a* can be utilized (FIG. 2**), with or without a sealing band as desired.

MODIFIED CAP WITH PROJECTING NOZZLE AND CHECK VALVES

If a liquid product having a low viscosity is to be dispensed from our container, suitable check valves may be employed in the outlet passage $P_3$ of the nozzles. Such check valves are shown in FIG. 13 in a modified nozzle 17*b*. The check valves may include a simple ball 60, formed of a suitable plastic or metal material. A backup spring 61 may be employed to urge the ball 60 against the cooperating seat in the outlet passage. The spring is selected to be sufficiently strong to resist the static head pressure of the product when the container is turned upside-down to obviate accidental spillage. A sleeve 62 serves to lock the spring in position and during assembly is placed behind the ball and spring 60, 61. This sleeve may be permanently fixed in position by previous application of suitable plastic weld solvent applied prior to the insertion.

Another variation within the more specific concepts of our invention is also shown in FIG. 13. As will be recognized, two outlet passages with additional check valve combinations 65, 66 are shown in communication with the chamber of the upper plunger cup 12*b*. The two passages are useful when dispensing products where two beads $b_1$, $b_2$ of one product are desired to be dispensed on opposite sides of the main product bead $b_3$, as shown in this Figure. Liquid two-part epoxy is one example where this arrangement would be useful to assure a good mix of the product beads. With the mix occurring outside the container (note product beads) there is no problem of deleterious hardening inside the nozzle.

Also, providing the two passages gives the designer of the specific container additional flexibility to gain the proper flow of a product, such as a product with a difficult viscosity to handle. Rotatable snap-in (one-way to prevent removal) nozzle extensions 67, 68 can serve to direct the product beads at different lateral locations. Separate caps and/or stoppers (not shown) may be provided for the multiple outlets, if desired.

In order to conserve space within the container, allow maximum product filling, and reduce the overall height of the piston 14, the nozzle 17*b* may project above the top of the cap 13*b*, as shown in FIG. 14. The outer dimensions of the nozzle are limited so as to fit or nest within the quadrilateral space formed by four containers sitting edge-to-edge, such as in a shipping container.

FILLING AND ASSEMBLY PROCESS

The interlocking system of parts that has been described above as a feature of the invention, complements the filling and assembling process. These two features together greatly enhance the economic feasibility of the package.

The first step illustrated in FIG. 15 depicts the first station of an in-line conveyor system. The base cup 11 is being filled with fluid product from a suitable automatic dispensing spout 71. The base cup 11 may be supported on a suitable flat conveyor C, but it is to be understood that any type of conveyor and automatic filling equipment may be used. The in-line conveyor system is preferred since there are existing in-line machines that can be set up with minimum modification to perform the required container handling, filling and assembling all the way to cartoning of the finished containers. One skilled in the art can recognize that other machines employing rotary conveyors, turret mechanisms or the like could also be used.

The second step is concerned with loading the piston 14 into the plunger cup 12. For this purpose a suction cup handler 72 picks up the piston 14, moves the piston into the cup to the dotted line position and finally locks the cup in position by the snapping of the bead detents 26, 46. With the cup held by the detent, the suction cup handler 72 brings the subassembly into alignment with the base cup 11 and moves the plunger cup 12 down into the product and by alignment of the sides of the two cups 11, 12 the piston rod reduced portion 32 is snapped into the snap ring 33. During this assembly step, the product in the container is initially pressurized with the air escaping up the transfer tube 16 and the product finally filling the transfer tube to a position just below its upper lip.

The suction cup handler is released and withdrawn and at the next stage a second product filling spout 73 fills the plunger cup 12. The cup is filled to the upper edge of the nozzle opening in the side of the support ring 42 as shown. In the modified embodiment of FIGS. 13 and 14 where the nozzle 17*b* is located above the top, the plunger cup 12 can be filled all the way to the upper lip.

A second suction cup handler 74 picks up a cap 13 with the safety strip 50 attached thereto. The container thus far assembled is now fed between two guide rails 75, 76 that will support the plunger cup 12 while the cap 13 is being snapped into position. The handler 74 brings the cap 13 down almost to engagement with the top, and aligning finger 77 pivots inwardly against the strip 50 to insure that the lip 52 is tucked in. Then the handler 74 moves downwardly with sufficient force to snap the ring 40 onto the cup 12.

Lastly, in those containers utilizing the heat shrink band 55, the assembled container 10 now arrives at a station with heated air nozzles 80, 81 and 82, 83. These nozzles are directed in opposed relationship to each other and have air of sufficient temperature to cause the band 55 to instantly shrink and grip the two adjacent parts of the container and provide a final locking together and sealing from atmospheric conditions. When the nozzles are first turned on, the opposed relationship of the nozzles (at an approximately ninety degrees included angle) the aerodynamic forces center the band 55. Of course, additional mechanical helper fingers swinging into position can assist the band aligning process, if desired or necessary.

In summary, a container and the process of assembling and filling the container has been provided that will offer manufacturers an exceptional new concept. No force, other than outside manual pressure is required for dispensing; the container is inexpensive, aesthetically pleasing, tamper-proof and safe to be around children; and easy and economical to fill and assemble. The interlock system of the four parts of the container assure proper positioning of the parts as well as foolproof locking. When the product has been totally dispensed from the container, the container is easily disposed of by the consumer. Codispensing of different products is possible with no modification of the basic container structure. Flow control inserts can be used to easily regulate the flow pattern from the dispenser. The container is fully sealed on the shelf for maximum shelf life. Products along the full spectrum of viscosities, from a thin liquid to a viscous liquid to flowable granular product can be packaged.

In this disclosure, there is shown and described only the preferred embodiments of the invention, but, as aforementioned, it is to be understood that the invention is capable of use in various other combinations and environment and is capable of changes or modifications within the scope of the inventive concept as expressed herein.

What is claimed is:

1. A dispensing container assembly for fluid products operable by outside manual pressure comprising:

a base cup open at the top;

a plunger cup telescopingly fitting in said cup through the open top and relatively slidable therein;

sealing means between said cups;

a nozzle directly communicating with said plunger cup through a first feed passage and having a second feed passage for receiving fluid from said base cup;

transfer tube means directly communicating at a first end with said nozzle through said second feed passage, said tube means passing through said plunger cup and opening at a second end into said base cup;

a slidable piston in said plunger cup relatively fixed with respect to said base cup whereby the same or different products in said cups may be simultaneously directly dispensed to said nozzle upon application of outside pessure to said cups; and said transfer tube means is integrally formed along one wall of the plunger cup, said piston having a cut-out portion accommodating said transfer tube.

2. The dispensing container assembly of claim 1 wherein there is further provided a cap on at least one of said cups, said cap permitting filling of product, locking means on said cap to hold against removal once installed during the assembly process, and said nozzle being formed integrally with said cap.

3. The dispensing container assembly of claim 2 wherein said nozzle has a connector forming said second feed passage and connecting the adjacent end of said tube means.

4. The dispensing container assembly of claim 3 wherein said connector has locking means for attaching to said tube means to assist in holding said cap means in position.

5. The dispensing container assembly of claim 2 wherein is further provided locking means to positively hold said plunger cup relative to said base cup to prevent telescoping movement, whereby said container assembly may be handled without accidental spillage of product from the cups.

6. A dispensing container assembly for fluid products operable by outside manual pressure comprising:

a base cup open at the top;

a plunger cup telescopingly fitting said cup through the open top and relatively slidable therein;

sealing means between said cups;

a nozzle directly communicating with said plunger cup through a first feed passage and having a second feed passage for receiving fluid from said base cup;

transfer tube means directly communicating at a first end with said nozzle through said second feed passage, said tube means passing through said plunger cup and opening at a second end into said base cup; and a slidable piston in said plunger cup relatively fixed with respect to said base cup whereby separate products contained in said cups may be simultaneously directly dispensed to said nozzle upon application of outside pressure to said cups;

said plunger cup including locking means comprising an integral snap ring for connecting a piston rod on said piston to the bottom of said base cup, snap bead means between said piston and said plunger cup to positively initially position said base and plunger cups in a fully expanded position and to prevent telescoping movement therebetween, whereby said container assembly may be assembled and handled without accidental spillage of product from the cups.

7. A dispensing container assembly for fluid products operable by outside manual pressure comprising:

a base cup open at the top;

a plunger cup telescopingly fitting in said base cup through the open top and relatively slidable therein;

sealing means between said cups;

a nozzle for dispensing fluid products from each of said cups;

separate passages independently and directly communicating between each of said cups and said nozzle;

slidable piston means in said plunger cup, said piston means including integral wiper means for wiping the inside surface of the plunger cup, said piston means relatively fixed with respect to said base cup whereby the same or different products contained in said cups may be simultaneously directly dispensed to said nozzle upon application of said outside pressure to said cups; and locking means to positively hold said plunger cup in an extended position relative to said base cup to prevent telescoping movement therebetween, said plunger cup locking means including cooperating locking means disposed adjacent the bottom of said plunger cup to snap in a locking relationship, whereby said container assembly may be handled prior to use without accidental spillage of product from the cups.

8. The dispensing container assembly of claim 7 further including an integral snap ring on the bottom of said base cup piston rod means connected to said piston means and a reduced portion and undercut groove at the bottom of said rod means for engagement with said snap ring.

9. The dispensing container assembly of claim 7 wherein said locking means includes a removable safety strip extending between a shoulder adjacent the top of the plunger cup and a rim at the top of the base cup, said strip being substantially rigid to prevent inward telescoping movement of said plunger cup in the base cup, said strip having a weakened portion to allow removal for initiating use of the container.

10. The dispensing container assembly of claim 7 wherein is further provided a heat shrink band extending around the girth of the container at the interface between the plunger cup and the base cup, said band snugly engaging both cups to seal the interface and to assist in locking the cups together.

11. The dispensing container assembly of claim 10 wherein said band is spot welded to the bottom of said strip for ease of initial positioning during the assembly process and for tearing and removal to commence use of the container.

12. The dispensing container assembly of claim 1 including a cap means on at least one of said cups, one of said cap means permitting filling of product, locking means on said cap means to hold against removal once installed during the assembly process, and said nozzle means being formed integrally with one of said cap means.

13. A dispensing container assembly for fluid products operable by outside manual pressure comprising a base cup open at the top;

a plunger cup telescopingly fitting in said cup through the open top and relatively slidable therein;

sealing means between said cups;

nozzle means directly communicating with said cups;

slidable piston means in said plunger cup relatively fixed with respect to said base cup whereby the same or different products in said cups may be simultaneously directly dispensed to said nozzle means upon application of outside pressure to said cups;

a piston rod on said piston passing through an aperture in the bottom of said plunger cup;

one-way snap locking means for permanently attaching the distal end of said rod to the bottom of said base cup; and locking means between said piston and said plunger cup to positively initially position said container cup in the fully expanded position;

whereby said container may be assembled by use of snap-together parts not easily taken apart and filled with product concurrently.

14. The container assembly of claim 13 wherein is provided cap means on top of said plunger cup, and one-way snap locking means on said cap means to hold against removal once installed during the assembly process.

15. The container assembly of claim 13 wherein said piston and plunger cup locking means includes an integral peripheral bead means extending around said piston and cooperating bead means on the inside of said plunger cup.

16. The container assembly of claim 13 wherein said one-way snap locking means for said rod includes a reduced portion and undercut groove on the distal end of said rod, and a snap ring integral with said base cup for snapping and locking over said reduced portion, said snap ring forming a smooth continuation of said rod to provide a seal with the aperture in the bottom of said cup.

* * * * *